US006204225B1

(12) United States Patent
Lightcap, Jr.

(10) Patent No.: US 6,204,225 B1
(45) Date of Patent: Mar. 20, 2001

(54) WATER-DISPERSIBLE METAL WORKING FLUID

(75) Inventor: Donald V. Lightcap, Jr., Woodburn, IN (US)

(73) Assignee: Midwest Biologicals, Inc., Woodburn, IN (US)

( * ) Notice: Subject to any disclaimer, the term of this patent is extended or adjusted under 35 U.S.C. 154(b) by 0 days.

(21) Appl. No.: 09/460,263

(22) Filed: Dec. 13, 1999

(51) Int. Cl.[7] ..... C10M 105/38; B21B 45/02

(52) U.S. Cl. ..... 508/178; 508/491; 508/501; 508/508; 508/562; 72/42

(58) Field of Search ..... 72/42; 508/178, 508/491

(56) References Cited

U.S. PATENT DOCUMENTS

| | | | | |
|---|---|---|---|---|
| Re. 31,242 | * | 5/1983 | Andlid et al. | 252/49.5 |
| 3,702,301 | | 11/1972 | Baldwin | 252/56 |
| 3,799,875 | | 3/1974 | Rohde | 252/48.8 |
| 3,929,652 | | 12/1975 | Seni et al. | 252/46.7 |
| 3,994,943 | * | 11/1976 | Gibble et al. | 260/424 |
| 4,115,285 | | 9/1978 | Van Hesden | 252/32.5 |
| 4,130,493 | * | 12/1978 | Inoue | 252/28 |
| 4,150,045 | * | 4/1979 | Sinha | 260/424 |
| 4,154,750 | * | 5/1979 | Moore et al. | 260/424 |
| 4,237,021 | * | 12/1980 | Andlid et al. | 252/49.5 |
| 4,416,788 | | 11/1983 | Apikos | 252/31 |
| 4,578,202 | | 3/1986 | Urban et al. | 252/33.4 |
| 4,654,155 | * | 3/1987 | Kipp et al. | 252/32.5 |
| 4,778,614 | | 10/1988 | Rawlinson et al. | 252/49.5 |
| 4,948,521 | * | 8/1990 | Stewart, Jr. et al. | 252/28 |
| 4,978,465 | * | 12/1990 | Sturwold | 252/48.4 |
| 5,124,055 | | 6/1992 | Perozzi | 252/46.7 |
| 5,322,631 | | 6/1994 | Fuchigami et al. | 252/33.2 |
| 5,372,220 | | 12/1994 | Jacobs et al. | 184/6.14 |
| 5,380,469 | | 1/1995 | Flider | 252/565 |
| 5,399,274 | | 3/1995 | Marcus | 252/49.3 |
| 5,413,726 | | 5/1995 | Landis | 252/49.8 |
| 5,417,869 | | 5/1995 | Giacobbe et al. | 252/33.6 |

* cited by examiner

*Primary Examiner*—Ellen M. McAvoy
(74) *Attorney, Agent, or Firm*—Mark F. Smith; Smith, Guttag & Bolin Ltd.

(57) ABSTRACT

A water-dispersible cooling and lubricating composition effective for use as a metal working fluid or a metal removal fluid. The composition comprises an oil and water emulsion prepared from a pre-emulsion concentrate having a high concentration of crude, degummed vegetable oil which can be combined with esters of such vegetable oil. The metal working fluid composition of the present invention is prepared by mixing the crude vegetable oil with alkyl esters as an antigumming agent, a corrosion inhibitor, a surfactant, a saponifier, a buffer, and a preservative to form a pre-emulsion concentrate. In a preferred embodiment of the invention, the pre-emulsion concentrate further comprises a fragrance. To form the desired metal working fluid composition of the present invention, the pre-emulsion concentrate is mixed with water to form a stable metal working fluid composition of the present invention.

20 Claims, No Drawings

WATER-DISPERSIBLE METAL WORKING FLUID

BACKGROUND OF THE INVENTION

This invention relates to a cooling and lubricating composition and more specifically, to a water-dispersible cooling and lubricating composition particularly effective for use as a metal working fluid or as a metal removal fluid.

Metal working fluids or metal removal fluids, hereinafter referred jointly as "metal working fluids," are used for lubrication of metal cutting and forming tools. They also provide cooling for the tooling, the removal of cut chips or fragments away from the tool/work piece interface, and to provide an acceptable post-machining finished surface. Metal working fluids also have an effect of reducing the cutting forces exerted on a tool and a work piece thereby extending the life of the cutting tool significantly.

Metal working fluids are classified according to their composition and are classified as being either a Soluble Oil, a Semisynthetic Fluid, or a Synthetic Fluid. Soluble Oil metal working fluids contain no appreciable amounts of water and are provided to the end user as an oil containing speciality additives. The oil content of a Soluble Oil metal working fluid ranges from about 50–70 percent by weight of oil and typically comprise one or more mineral oils, chlorinated or sulfurized mineral oils, fatty oils, or mixtures thereof Soluble Oil metal working fluids are typically diluted with water at the user's site, from about 1–20 percent with about 5–7 percent (15:1) being the most common dilution level. Soluble oils based on mineral oil have been criticized because of their cost, flammability, their tendency to smoke, and the concern for toxicity of the aromatic compounds associated with mineral oils which may cause air quality problems in and around the cutting tools.

A Semisynthetic Fluid for metal working differs from Soluble Oil metal working fluid in that the semisynthetic neat product concentrate contains a significant amount of water, typically up to about 50–60 percent. The oil content of such metal working fluids typically ranges from about 10–40 percent and typically comprises mineral oil, an emulsifier, and other additives which, when added to water and stirred, form an oil-in-water emulsion. Such Semisynthetic Fluids used for metal working are relatively expensive and often cause air quality problems in and around the metal working tools.

A Synthetic Fluid for metal working contains a majority of water in the neat fluid and contains no mineral or vegetable oil. Functionality (lubricity, corrosion inhibition, extreme pressure functions, and the like) is provided by speciality additives. Water content of Synthetic Fluids typically comprises about 60–80 percent by weight of the metal working fluid. Synthetic Fluids, however, are relatively expensive compared to other conventional metal working fluids.

The additives in conventional metal working fluids used for metal removal often contain large amounts of sulfur. These can be in the form of sulfurized oils, sulfonates, or sulfates. The presence of significant amounts of sulfur in a metal working fluid provides nutritional sustenance for anaerobic sulfate-reducing bacteria, resulting in formation of hydrogen sulfide in the operating system. Hydrogen sulfide is extremely corrosive in very small quantities and produces an objectionable odor. Higher concentrations of hydrogen sulfide can also cause health problems.

Vegetable oils are known for having excellent lubricating properties as well as being environmentally and human considerate. For this reason they have been used in metal working fluids as lubricant additives and their reaction products have been used for lubricating purposes. Refined vegetable oils have also been used in metal working by adding water-dispersible phosphatides. However, Soluble Oil metal working fluids have not been developed that comprise a majority of crude or partially-refined vegetable oils due to the difficulties in formulating a stable pre-emulsion concentrate comprising a majority of crude or partially-refined (degummed) vegetable oils; the difficulties of providing sufficient water dispersibility; the difficulties in formulating with water-soluble corrosion inhibitors; the tendency for vegetable oils to biodegrade (go rancid) during use; the tendency for partially-refined vegetable oils to produce gumming when exposed to extreme temperatures and pressures; the tendency for vegetable oils to form a sticky residue on surfaces at ambient temperatures with time; and the objectionable odors of crude vegetable oils.

Other conventional metal working fluids that have been developed for use in the metal working industry and comprise refined fatty oils. However, refined fatty oils are significantly more expensive than nonrefined oils. Unfortunately, the presence of metal chips and bacteria in the metal working fluid limits its effective useful life. Accordingly, the use of such refined oils is relatively expensive.

Consequently, a need exists for a metal working fluid which is non-toxic, stable, ecologically acceptable, relatively inexpensive, and is effective for reducing friction caused by removing material from the cut surface of the work piece and for carrying away the heat generated by the frictional contact between the cutting or forming tool and the work piece. Further, a need exists for a metal working fluid which is non-foaming, non-inflammable, and which does not corrode ferrous metals.

SUMMARY OF THE INVENTION

The present invention is directed to an improved water-dispersible metal working fluid composition which is effective for reducing friction caused by removing material from a cut surface of a work piece and for carrying away material chips and the heat generated by the frictional contact between a cutting or metal working surface of a metal working tool and the work piece.

In a preferred embodiment of the invention, the metal working fluid comprises a pre-emulsion concentrate comprising a vegetable oil, an anti-gumming agent, at least one surfactant, a saponifier, a buffer, at least one corrosion inhibitor, at least one preservative, and an antifoaming agent.

In another preferred embodiment of the invention, the pre-emulsion concentrate is mixed with water to provide the desired concentration of the metal working fluid.

In another preferred embodiment of the invention, the vegetable oil is a crude (non-refined or non-purified) degummed oil.

In another preferred embodiment of the invention, the metal working fluid further comprises a fragrance.

In another preferred embodiment of the invention, the metal working fluid further comprises esters of the vegetable oil.

In another preferred embodiment of the invention, the metal working fluid comprises a surfactant formed from an alky ester.

In another preferred embodiment of the invention, the metal working fluid comprises a surfactant selected from the group consisting of etheric nonionic surfactants, esteric nonionic surfactants, alkali metal salts of an alkylsulfonic acid, alkali metal salts of an alkylarylsulfonic acid, and alkali metal salts of an carboxylic acid, as well as mixtures of these surfactants.

In another preferred embodiment of the invention, the metal working fluid comprises an etheric nonionic surfactant selected from the group consisting of polyoxyalkylene phenylethers, polyoxyalkylene glycols, polyoxyalkylene alkyl ethers, polyoxyalkylene alkylnaphthyl ethers, and polyoxyalkylene abiethyl ethers.

In another preferred embodiment of the invention, the metal working fluid comprises an esteric nonionic surfactant selected from the group consisting of polyoxyalkylene alkylene glycol carboxylic acid esters, polyoxyalkylene monocarboxylic acid esters, polyoxyalkylene dicarboxylic acid esters, polyoxyalkylene sorbitan monocarboxylic acid esters, polyoxyalkylene sorbitan tricarboxylic acid esters, sorbitan tricarboxylic acid esters, sorbitan monocarboxylic acid esters, sorbitan sesquicarboxylic acid esters, pentaerythritol monocarboxylic acid esters, glycerin monocarboxylic acid esters, alkali metal salts of an alkylsulfonic acid and alkali metal salts of an alkylaryl sulfonic acid, including alkylbenzene sulfonates, alkyl sulfonates, a-olefin sulfonates, polyoxyethylene isooctylphenyl ether sulfonates, petroleum sulfonates, dialkyl sulfosuccinates, lower dialkyl naphthalenesulfonates, alkyl sulfoacetates, alkylphenyl ether disulfonates, dinaphthylmethane sulfonates, a-sulfocarboxylates, lignin sulfonates, monoalkyl sulfosuccinates, and alkylphenol sulfonates.

In another preferred embodiment of the invention, the metal working fluid comprises a potassium hydroxide saponifier.

In another preferred embodiment of the invention, the metal working fluid comprises a triethanolamine buffer.

In another preferred embodiment of the invention, the metal working fluid comprises an ethylenediaminetetraacetic acid (EDTA) buffer.

In another preferred embodiment of the invention, the metal working fluid comprises a corrosion inhibitor selected form the group consisting of alkanolamides, alkanolamine borates (borate esters), phenothiazines, amine carboxylates, benzotriazole, mercaptobenzothiazole, tolyltriazines, triethanolamine, salts of alkyl aryl sulfonates, and alkyl carboxyl phosphonates.

In another preferred embodiment of the invention, the metal working fluid comprises a preservative selected from the group consisting of polymeric quaternary ammonium compounds, phenols, pyridinethione, dioxanes, bromonitriles, gluteraldehyde, isothiazolones, thiocyanobenzothiazole, and formaldehyde condensates.

In another preferred embodiment of the invention, the metal working fluid comprises an anti-foaming agent selected from the group consisting of silicone based agents, polypropylene glycols, and polyglycol copolymers of ethylene and propylene oxide.

In another preferred embodiment of the invention, the metal working fluid further comprises an antigumming agent.

In another preferred embodiment of the invention, the metal working fluid is formed from a pre-emulsion concentrate which is stable and does not separate during storage.

In another preferred embodiment of the invention, a metal working fluid is formed by the process comprising the steps of first placing vegetable oil into a mixing vessel; then heating the vegetable oil to a preselected temperature; then mixing in an antigumming agent, a corrosion inhibitor, and a surfactant with the heated vegetable oil; then adding a saponifier; and finally mixing a buffer into the composition to form a pre-emulsion concentrate.

In another preferred embodiment of the invention, the pre-emulsion concentrate is mixed with water to form a metal working fluid having the desired concentration.

In another preferred embodiment of the invention comprises a method of providing lubrication and cooling to metal working tooling comprising the step of applying the metal working fluid of the present invention to the metal being worked in an amount effective for providing lubrication and cooling.

A primary object of this invention, therefore, is to provide a metal working fluid which is effective for reducing friction caused by removing material from the worked surface of a work piece and for carrying away the heat generated by the frictional contact between a metal working tool and the work piece;

Another primary object of this invention is to provide a metal working fluid which is stable and does not separate during storage;

Another primary object of this invention is to provide a metal working fluid which is formed from a pre-emulsion concentrate which is stable and does not separate during storage;

Another primary object of this invention is to provide a metal working fluid which is non-toxic;

Another primary object of this invention is to provide a metal working fluid which is ecologically acceptable;

Another primary object of this invention is to provide a metal working fluid which is relatively inexpensive;

Another primary object of this invention is to provide a metal working fluid which in noninflammable; and Another primary object of this invention is to provide a metal working fluid which does not corrode ferrous and non-ferrous metals.

Another primary object of this invention is to provide a method of providing lubrication and cooling to metal working tooling.

These and other objects and advantages of the invention will be apparent from the following description and the appended claims.

DESCRIPTION OF THE PREFERRED EMBODIMENT

This invention is directed to a Soluble Oil metal working fluid comprising a majority of degummed crude (non-refined or non-purified) vegetable oil, preferably soy oil. The term "metal working" as used in the present specification is intended to include metal working operations such as cutting, drilling and grinding. The term "crude" as used in the present specification refers to a non-refined or a non-purified oil. Degumming, as used herein, is a process that removes undesirable water-dispersible phosphatides such as lecithin and cephalin. These water-dispersible phosphatides are removed by settling and water extraction from the crude vegetable oils. Vegetable oils, that have been degummed, however, will retain the naturally-occurring antioxidants which act as preservatives. These oils also retain (following water extraction, or degumming, of the water dispersible phosphatides or lecithins) their naturally-occurring oil-soluble phosphatides which have been found to act as extreme pressure lubricants.

Typical compositions of a vegetable oil (soy oil) in ppm:

| | Refined | Crude Degummed |
|---|---|---|
| Tocopherol | 900 | 1300–2000 |
| phosphorus | 5 | 200 |
| free fatty acid (as oleic) | 1000 (0.1%) | 6000–22,000 (0.6–2.2%) |

The metal working fluid of the present invention comprises an oil and water emulsion prepared from a pre-emulsion concentrate having a high concentration of crude (non-refined or non-purified), degummed vegetable oil which can be combined with esters of the vegetable oil. Preferably, the oil comprises soya oil, however, other crude suitable vegetable oils include seed oils such as coconut oil, corn oil, cottonseed oil, palm oil, rapeseed oil (canola), sesame seed oil, and sunflower oil. It should now be apparent to those skilled in the art that a metal working fluid comprising a crude vegetable oil as a base component will be significantly less expensive than conventional metal working fluid compositions that require refined vegetable oils as a base component.

The pre-emulsion concentrate is prepared by using a surfactant that is suitable for providing a stable oil and surfactant composition having a large percentage of crude vegetable oil and esters derived from the vegetable oil. Until now, crude vegetable oils have not been developed for use in the metal working industry as metal working fluids due to the difficulty and expense of preparing a stable pre-emulsion concentrate having sufficient water dispersibility necessary for the metal working fluid composition as well as the difficulty of formulating with water-soluble corrosion inhibitors; the tendency for vegetable oils to biodegrade (go rancid) during use; the tendency for degummed vegetable oils to produce gumming when exposed to extreme temperatures and pressures; the tendency for vegetable oils to form a sticky residue on surfaces at ambient temperatures with time; and the objectionable odors emitted by crude vegetable oils. However, it has been found that etheric nonionic surfactants, esteric nonionic surfactants, alkali metal salts of alkyl sulfonic acids, alkali metal salts of alkylarylsulfonic acids, alkali metal salts of carboxylic acids, including mixtures of these surfactants, may be used in the present invention to facilitate the formation of a crude vegetable oil pre-emulsion concentrate.

The metal working fluid composition of the present invention is prepared by mixing about 50% to about 95%, more preferably about 50% to about 70%, by weight of crude vegetable oil; about 3% to about 20%, more preferably about 8% to about 15%, by weight of alkyl esters as an antigumming agent; about 0.1% to about 2%, more preferably about 0.3% to about 1.5% of a corrosion inhibitor; about 5% to about 50%, more preferably about 10% to about 30, by weight of a surfactant; about 1% to about 9%, more preferably about 2% to about 5%, by weight of potassium hydroxide (50% concentration) saponifier; about 2% to about 15%, more preferably about 4% to about 12%, by weight of triethanolamine as a buffer; with about 0.1% to about 2%, more preferably 0.2% to about 1.5% by weight of a preservative; to form a pre-emulsion concentrate. In a preferred embodiment of the invention, about 0.01% to about 5%, preferably 0.05% to about 2%, by weight of a fragrance is added to the composition to reduce any objectionable order that may be emitted from the composition. The pre-emulsion concentrate may then be stored until ready to use or shipped to the ultimate customer for use. To form the desired metal working fluid composition of the present invention, the pre-emulsion concentrate is mixed with water to form a stable metal working fluid composition of the present invention. The ratio of pre-emulsion concentrate to water can vary to provide the desired concentration of the resulting metal working fluid. Typically, ratio by volume of water to pre-emulsion concentrate is about 10:1 to about 20:1.

A surfactant which has been found to be particularly effective for producing a stable pre-emulsion concentrate that will not separate during conditions of long term storage comprises a 3 mole ethylene oxide adduct of a mixture of C12 and C14 alcohols. In preparing the surfactant, about 30% to about 50% by weight of C12 alcohol is first mixed with about 50to about 70% C14 alcohol. The mixture of C12 and C14 alcohols are then ethoxylated with 3 moles of ethylene oxide to produce the desired emulsifier.

In a preferred embodiment of the present invention, the pre-emulsion concentrate comprises about 88% of a crude soya oil and about 11% by weight of a surfactant comprising a 3 mole ethylene oxide adduct of the mixture of C12 and C14 alcohols. The oil and surfactant are intimately blended together at about 70 to about 100 degrees Fahrenheit (21° C. –38° C.) to form a pre-emulsion concentrate. To produce the desired metal working fluid of the present invention, the pre-emulsion concentrate is added to water to form a metal working fluid having the desired concentration. It should now be apparent to one skilled in the art that a higher or a lower dilution may be useful in certain applications.

Other surfactants, such as an etheric nonionic surfactant, esteric nonionic surfactants, alkali metal salts of alkyl sulfonic acids, alkali metal salts of alkylarylsulfonic acids, and alkali metal salts of carboxylic acids have been found to be effective for providing a stable pre-emulsion concentrate. The nonionic surfactants that have been found suitable for producing a stable pre-emulsion concentrate possess a hydrophilic/lipophilic balance (HLB) of 11.0–13.0, and certain oxide levels between 4.0 and 11.0 moles. These properties have been found to be critical to ensure dispersibility of the pre-emulsion concentrate into a wide range of water hardnesses.

The etheric nonionic surfactants that have found to be effective include polyoxyalkylene phenyl ethers, polyoxyalkylene glycols, polyoxyalkylene alkyl ethers, polyoxyalkylene alkylnaphthyl ethers, and polyoxyalkylene abiethyl ethers.

The esteric nonionic surfactants may be selected from the group consisting of polyoxyalkylene alkylene glycol carboxylic acid esters, polyoxyalkylene monocarboxylic acid esters, polyoxyalkylene dicarboxylic acid esters, polyoxyalkylene sorbitan monocarboxylic acid esters, polyoxyalkylene sorbitan tricarboxylic acid esters, sorbitan tricarboxylic acid esters, sorbitan monocarboxylic acid esters, sorbitan sesquicarboxylic acid esters, pentaerythritol monocarboxylic acid esters, glycerin monocarboxylic acid esters.

Alkali metal salts of alkyl sulfonic acids and alkali metal salts of alkyl aryl sulfonic acids suitable as surfactants include alkyl benzene sulfonates, alkyl sulfonates, a-olefin sulfonates, polyoxyethylene isooctylphenyl ether sulfonates, petroleum sulfonates, dialkyl sulfosuccinates, lower dialkyl naphthalene sulfonates, alkyl sulfoacetates, alkyl phenyl ether disulfonates, dinaphthylmethane sulfonates, a-sulfocarboxylates, lignin sulfonates, monoalkyl sulfosuccinates, and alkyl phenol sulfonates.

The order of the process of preparation has been unexpectedly found to be critical in preparing a stable pre-emulsion concentrate. If the saponification steps are performed initially, prior to adding the oil, the resulting pre-emulsion concentrate will separate, at ambient temperatures, within a 24 hour time span. It was unexpectedly found that by adding the antigumming agent, corrosion inhibitors and the surfactants prior to the addition of the saponifier (preferably potassium hydroxide) and by introducing the buffer (preferably triethanolamine) after the saponifier, one obtains a clear and stable pre-emulsion concentrate.

In order to further illustrate the present invention and the advantages thereof, the following specific examples are given, it being understood that the same are intended only as illustrative and nowise limitative.

The metal forming fluid of the present invention were produced by forming pre-emulsion concentrates having the following compositions and mixing water to the pre-emulsion concentrate to form the following metal working fluid:

| | Weight % | | | | | |
|---|---|---|---|---|---|---|
| Material<br>Example | A<br>(6-68) | B<br>(6-102) | C<br>(6-129) | D<br>(7-30) | E<br>(7-31) | F<br>(7-45) |
| Crude soy oil (degummed) | 57.5 | 66.9 | 64.3 | 56.7 | 56.7 | 56.6 |
| Methyl soyate (Nevtac100) | 10.5 | 11.1 | 10.0 | 10.8 | 10.5 | 10.8 |
| Potassium hydroxide (50%) | | 3.6 | 3.0 | 3.6 | 3.6 | 3.6 |
| Triethanolamine (99%) | 5.0 | 8.9 | 8.0 | 11.5 | 11.5 | 11.5 |
| Nonyl phenol alkoxylate | 8.0 | 4.5 | 6.0 | 13.4 | 13.4 | 13.4 |
| Dodecylphenol alkoxylate | 8.0 | 4.5 | 6.0 | | | |
| Alcohol alkoxylate | 1.0 | 0.5 | 1.0 | 3.4 | 3.4 | 3.4 |
| Phosphonate (Bayhibit AM) | 0.5 | | 0.3 | 0.3 | 0.3 | 0.3 |
| Sodium sulfonate | 7.5 | | | 0.3 | | 0.3 |
| Alkanolamide (Mazon RI 6) | | | 0.7 | | 0.6 | |
| Isocil IG | | | | | | 0.1 |
| Hydrocarbon resin (40%) | 2.0 | | | | | |
| Fragrance | <0.1 | 0.7 | <0.1 | <0.1 | <0.1 | |
| Antifoam | | <0.1 | <0.1 | <0.1 | <0.1 | <0.1 |

The incorporation of triethanolamine as the buffer can be difficult. As shown in the following example A, the metal working fluid was prepared by saponification of the fatty acids in crude soy oil using triethanolamine. The pre-emulsion concentrate, however, separated within 24 hours at ambient temperature.

Soluble oil emulsions often become contaminated by bacteria, yeasts and molds. The growth of such micro-organisms typically cause problems such as emulsion breakdown, the production of slime and fungal mats, and the evolution of foul odors. Accordingly, it has been found that about 0.01% to about 2.0%, more preferably about 0.05% to about 1.0%, by weight of a biocide is preferably added to prevent the growth of such micro-organisms. It has also been surprisingly found, that the relatively high concentration of tocopherol (vitamin E) found in crude soya oil operates as a natural biocide and hinders the growth of such micro-organisms. Accordingly, for most applications the use of large amounts of an additional biocide is not required.

Quantities of sulfur-containing compounds have been minimized for the pre-emulsion composition in order to reduce the potential for sulfate reduction to hydrogen sulfide by anaerobic bacteria. These bacteria are very common and thrive in environments lacking free air oxygen. In general, these bacteria are not pathogenic, and are termed "nuisance bacteria" because of the objectionable odor of the hydrogen sulfide they produce. This condition typically occurs in metal working fluids that are permitted to sit, such as in the bottom of a sump over a weekend or for extended periods of time in a reservoir or stagnant places of a central system, and results in a distinct and objectionable odor being emitted. Hydrogen sulfide is also very corrosive in very small concentrations and can cause health problems in higher concentrations.

Example A was prepared by adding 43 grams soy oil to the charge vessel; heating to 140° F. (60° C.), with stirring adding 11.25 grams diluted sulfonate (available from King Industries under the designation SS/LB), 3.75 grams of triethanolamine, 6 grams dodecylphenol alkoxylate, 6 grams nonyl phenol alkoxylate, 0.75 grams alcohol alkoxylate, 0.375 grams phosphonate (available from Bayer Corporation under the name Bayhibit AM), and 3.75 grams of the diluted hydrocarbon resin. Dilution of the sulfonate was by adding 100 grams of the sulfonate to 100 grams of methyl soyate at 120° F. (49° C.) with stirring. Hydrocarbon resin dilution was achieved by adding 80 grams to about 120 grams of methyl soyate (available from the Neville Chemical Company under the name Nevtac 100) at 120° F. (49° C.) with stirring. The resulting composition was unacceptable as it was observed to remain cloudy upon cooling to ambient temperature and separated with 24 hours.

Example B was prepared by adding 60 grams soy oil and 10 grams methyl soyate to the charge vessel, heating to 115° F. (46° C.), with stirring, adding 3.2 grams potassium hydroxide and mixing for 20 minutes. After this, 8 grams of triethanolamine was added at 120° F. (49° C.), to produce a clear mixture. Four grams nonylphenol alkoxylate, 4 grams dodecylphenol alkoxylate, and 0.5 grams alcohol alkoxylate, were then added with stirring. The mixture remained clear upon subsequent cooling to ambient temperature, dispersed well into water, and produced minimal foaming when diluted with water.

Examples C was prepared by adding the soy oil (20.5 lbs.) and methyl soyate (3.2 lbs.) to the charge vessel, heating to 120° F. (49° C.), with stirring adding the Bayhibit AM (0.1 lb.), then the potassium hydroxide (1.0 lb.), and allowing to mix for 30 minutes. The 0.2 pounds of alkanolamide (Mazon RI 6), was added with mixing at 134° F. (57° C.), followed by the triethanolamine (2.56 lbs). The resulting product was hazy in appearance when checked for clarity. Nonylphenol alkoxylate (1.9 lbs), dodecylphenol alkoxylate (1.9 lbs), alcohol alkoxylate (0.32 lbs), and 80 grams of potassium hydroxide were combined with mixing in a separate vessel at ambient temperature, then charged to the product with mixing. After mixing for 20 minutes at 140° F. (60° C.), the product was clear of any haziness. 0.2 pounds of fragrance and 5 drops of antifoam were added last to this formulation which was then mixed for 1 hour while cooling to ambient temperature.

Example D was prepared by adding the soy oil (43.1 grams) and methyl soyate (8.0 g.) to the charge vessel, heating to 90° F. (32° C.), with stirring adding the Bayhibit AM (0.23 g.), 0.45 grams sodium sulfonate (50 percent diluted as in Example A, the nonylphenol alkoxylate, then the alcohol ethoxylate. Next, the potassium hydroxide was added slowly with stirring at 102° F. (39° C.) and allowed to stir for 30 after addition minutes. Triethanolamine was added thereafter at 116° F. (47° C.) with stirring to produce a clear product. After 30 minutes of stirring, the fragrance and antifoaming agent were added, and allowed to cool to ambient temperature.

Example E was prepared as Example D, substituting the Mazon RI 6 for the sulfonate.

Example F was prepared as Example D adding Isocil IG lastly.

The examples were used for cooling and lubricating a conventional metal working tooling and were tested in comparison with a conventional petroleum based metal working fluid for cutting stainless steel. After repeatedly cutting stainless steel bar, it was observed that the subject metal working fluid displayed an increased blade life of 33% for each example over a conventional petroleum based metal working fluid.

Testing for ferrous corrosion protection was performed according to ASTM 4627 Iron Chip Corrosion Test. Results indicated that the compositions of the claimed invention provide corrosion protection at the relevant usage concentrations.

ASTM D3946 Bacterial Resistance Test—This test measures the ability of a metalworking fluid exposed to aerobic and anaerobic conditions to resist bacterial and fungal growth. Working fluids were prepared by diluting the fluid concentrates 15 parts tap water to 1 part concentrate. Innoculum contained $1\times10^{11}$ microbes per milliliter. Results indicate that the metalworking fluid of the present invention provide excellent protection from rancidity and spoilage during the useful lifetime of the fluid in the relevant usage concentrations.

Further, the metal working fluid of the present invention displays other superior characteristics to other commercially available metal working fluids. More specifically, the metal working fluid of the present invention had superior lubricity, cooling properties, antifoaming properties and corrosion preventing properties for non-ferrous metals. Further, the metal forming fluid of the present invention is stable and does not separate during storage, is non-toxic, is ecologically acceptable, relatively inexpensive, and is non-inflammable.

While the composition herein described constitutes a preferred embodiment of this invention, it is to be understood that variations may be made therein without departing from the scope of the invention.

What is claimed is:

1. A water-dispersible metal working fluid comprising:

a vegetable oil;

an anti-gumming agent;

a surfactant;

a saponifier;

a buffer;

a corrosion inhibitor;

a preservative;

an antifoaming agent; and water.

2. The water-dispersible metal working fluid of claim 1, wherein said vegetable oil is degummed crude vegetable oil.

3. The water-dispersible metal working fluid of claim 1 further comprising a fragrance.

4. The water-dispersible metal working fluid of claim 1 further comprising esters of vegetable oil.

5. The water-dispersible metal working fluid of claim 1 wherein said surfactant is formed from an alky ester.

6. The water-dispersible metal working fluid of claim 1 wherein said surfactant is selected from the group consisting of etheric nonionic surfactants, esteric nonionic surfactants, alkali metal salts of alkylsulfonic acids, alkali metal salts of alkylarylsulfonic acids, and alkali metal salts of carboxylic acids, and mixtures thereof.

7. The water-dispersible metal working fluid of claim 1 wherein said surfactant comprises an etheric nonionic surfactant selected from the group consisting of polyoxyalkylene phenylethers, polyoxyalkylene glycols, polyoxyalkylene alkyl ethers, polyoxyalkylene alkylnaphthyl ethers, and polyoxyalkylene abiethyl ethers.

8. The water-dispersible metal working fluid of claim 1 wherein said surfactant is a nonionic surfactant selected from the group consisting of polyoxyalkylene alkylene glycol carboxylic acid esters, polyoxyalkylene monocarboxylic acid esters, polyoxyalkylene dicarboxylic acid esters, polyoxyalkylene sorbitan monocarboxylic acid esters, polyoxyalkylene sorbitan tricarboxylic acid esters, sorbitan tricarboxylic acid esters, sorbitan monocarboxylic acid esters, sorbitan sesquicarboxylic acid esters, pentaerythritol monocarboxylic acid esters, and glycerin monocarboxylic acid esters.

9. The water-dispersible metal working fluid of claim 6 wherein said alkali metal salts of alkylsulfonic and alkali metal salts of alkylaryl sulfonic acid are selected from the group consisting of alkylbenzene sulfonates, alkane sulfonates, a-olefin sulfonates, polyoxyethylene isooctylphenyl ether sulfonates, petroleum sulfonates, dialkyl sulfosuccinates, lower dialkyl naphthalenesulfonates, alkyl sulfoacetates, alkylphenyl ether disulfonates, dinaphthylmethane sulfonates, a-sulfocarboxylates, lignin sulfonates, monoalkyl sulfosuccinates, and alkylphenol sulfonates.

10. The water-dispersible metal working fluid of claim 1 wherein said saponifier is potassium hydroxide.

11. The water-dispersible metal working fluid of claim 1 wherein said buffer is triethanolamine.

12. The water-dispersible metal working fluid of claim 1 wherein said buffer is ethylenediaminetetraacetic acid.

13. The water-dispersible metal working fluid of claim 1 wherein said corrosion inhibitor is selected from the group consisting of alkanolamides, alkanolamine borates, phenothiazines, amine carboxylates, benzotriazole, mercaptobenzothiazole, tolyltriazines, triethanolamine, salts of alkyl aryl sulfonates, and alkyl carboxyl phosphonates.

14. The water-dispersible metal working fluid of claim 1 wherein said preservative is selected from the group consisting of polymeric quaternary ammonium compounds, phenols, pyridinethione, dioxanes, bromonitriles, gluteraldehyde, isothiazolones, thiocyanobenzothiazole, and formaldehyde condensates.

15. The water-dispersible metal working fluid of claim 1 wherein said anti foaming agent is selected from the group consisting of silicone based agents, polypropylene glycols, and polyglycol copolymers of ethylene and propylene oxide.

16. A method of providing lubrication and cooling to metal working tooling comprising the step of applying a metal working fluid to the metal being worked wherein the metal working fluid is that of claim 1 in an amount effective to provide lubrication and cooling.

17. A process for making a water-dispersible metal working fluid comprising the steps of:

(a) placing vegetable oil into a mixing vessel;

(b) heating the vegetable oil of step (a) to a preselected temperature;

(c) mixing the vegetable oil of step (a) with an antigumming agent, a corrosion inhibitor and a surfactant;

(d) mixing a saponifier into the mixture of step (c);

(e) mixing a buffer into the mixture of step (d) to form a pre-emulsion concentrate; and (f) mixing the pre-emulsion concentrate with water to form the metal working fluid.

18. The process of claim 17 further comprising the step of mixing the mixture of step (e) with a preservative.

19. The process of claim 17 further comprising the step of mixing the mixture of step (e) with a fragrance.

20. A water-dispersible metal working fluid comprising:

about 50% to about 95% by weight of crude vegetable oil;

about 3% to about 20% by weight of alkyl esters;

about 0.1% to about 2% of a corrosion inhibitor;

about 5% to about 50% by weight of a surfactant;

about 1% to about 9% by weight of potassium hydroxide;

about 2% to about 15% by weight of triethanolamine;

about 0.1% to about 2% by weight of a preservative; and about 0.01% to about 5% by weight of a fragrance.

* * * * *